US006287032B1

(12) United States Patent
Osmus et al.

(10) Patent No.: US 6,287,032 B1
(45) Date of Patent: Sep. 11, 2001

(54) MEDIA TRAY SUPPORTER AND METHOD OF USING SAME

(75) Inventors: James M Osmus, Escondido, CA (US); Yeo Chye Kuan Gavin, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/478,262

(22) Filed: Jan. 5, 2000

(51) Int. Cl.[7] ..... B41J 11/58

(52) U.S. Cl. ..... 400/624; 400/625; 400/691; 400/693

(58) Field of Search ..... 400/624, 625, 400/628, 629, 691, 692, 693; 271/3.01, 3.14, 163

(56) References Cited

U.S. PATENT DOCUMENTS 4,698,650 * 10/1987 Wantanabe et al. ..... 400/625 X
4,847,632 * 7/1989 Norris ..... 346/107
5,163,670 * 11/1992 Sellers et al. ..... 271/164 X
5,378,071 1/1995 Uehara ..... 400/636.1
5,620,269 4/1997 Gustafson ..... 400/624
5,743,518 4/1998 Takashimizu et al. ..... 271/4.1
5,746,528 * 5/1998 Mayer et al. ..... 400/625
5,829,898 11/1998 Hill et al. ..... 400/624
6,120,201 * 9/2000 McKay et al. ..... 400/691
6,132,122 * 10/2000 Robinson et al. ..... 400/624

* cited by examiner

*Primary Examiner*—John S. Hilten
*Assistant Examiner*—Minh Chau
(74) *Attorney, Agent, or Firm*—Jerry R. Potts

(57) ABSTRACT

The present invention provides a low profile stackable internet appliance printer having a removable combination input/output tray cassette with a support mounted therein for holding the output tray in substantially horizontal plane when the output tray is extended outwardly from the cassette a sufficient distance to support from below individual sheets of media discharged from the printer.

8 Claims, 10 Drawing Sheets

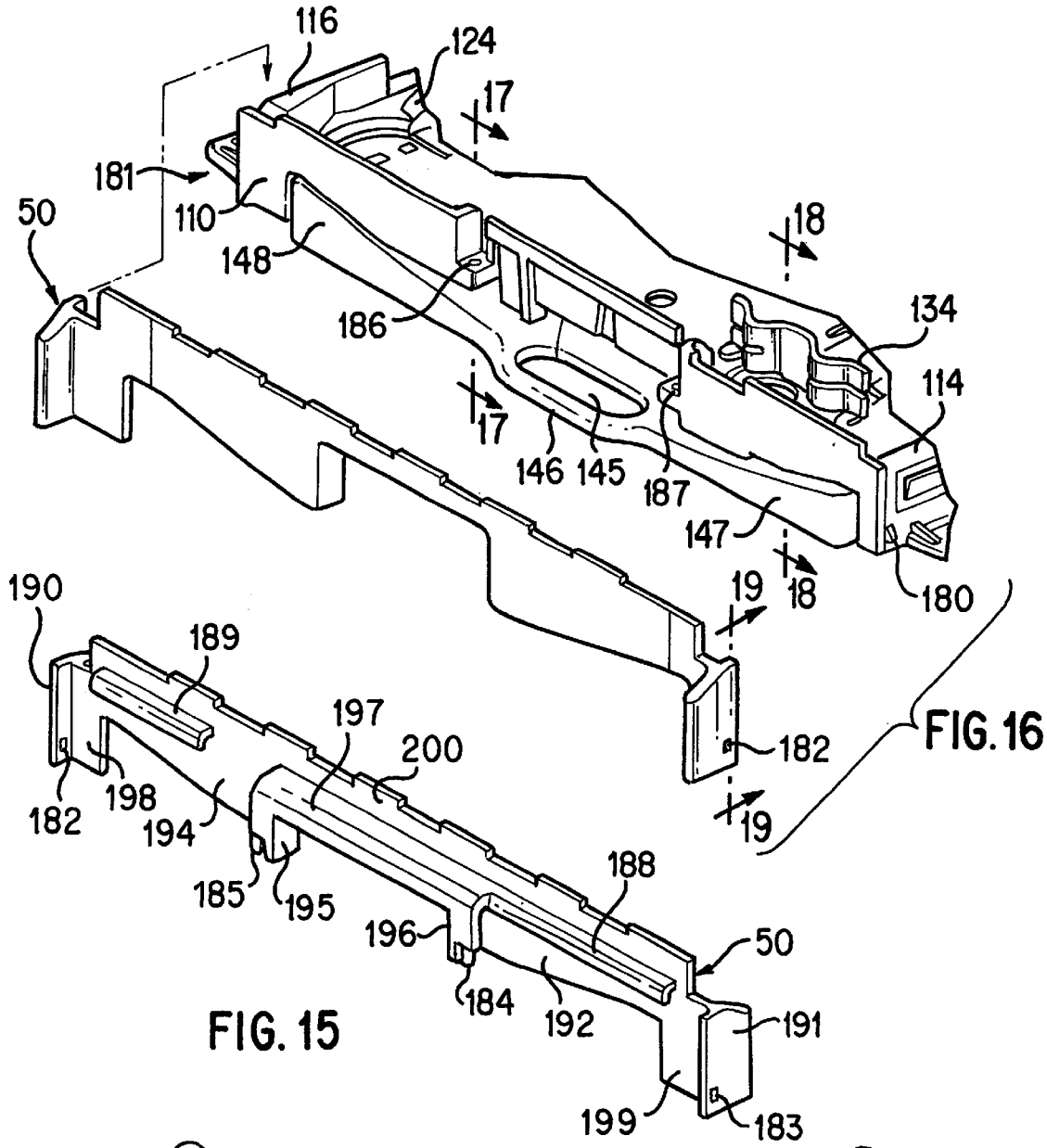
FIG. 16
FIG. 15
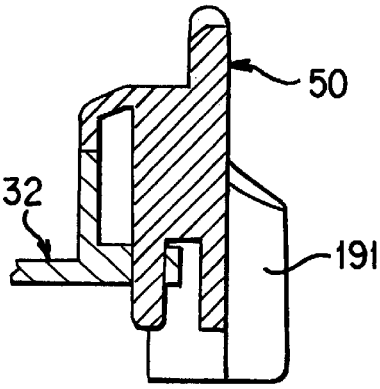
FIG. 17
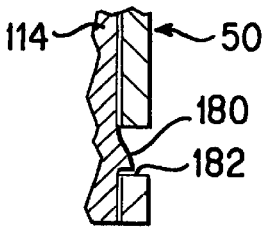
FIG. 19
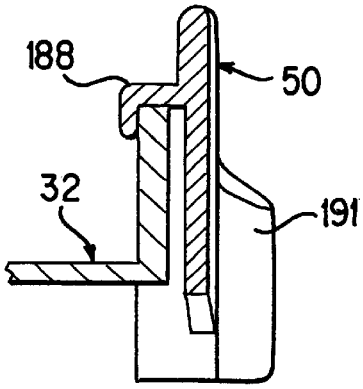
FIG. 18

MEDIA TRAY SUPPORTER AND METHOD OF USING SAME

RELATED APPLICATIONS

This application is related to the following copending utility patent applications, each filed concurrently on Jan. 5, 2000: Ser. No. 09/477,684 by James Osmus, entitled "Low Profile Printer with Open Bottom Paper Path"; Ser. No. 09/478,056 by Kerry McKay et al. entitled "Media Channel and Method of Clearing Media Jams", Ser. No. 09/477,937, by Kerry McKay et al. entitled "Stackable Printer And Method Of Using Same"; Ser. No. 09/477,939, by James Osmus, entitled "Media Observation Frame and Method of Using Same"; and Ser. No. 09/477,930, by James Osmus et. al. entitled: Bezel and Method of Using Same".

BACKGROUND OF THE INVENTION

1. Field of the Invention

The present invention relates generally to a hard copy document apparatus and method of using the apparatus and, more particularly, to a stackable low profile internet appliance printer and method of using the printer.

2. Description of Related Art

With the advent of the modern day computer and the explosion in .com Internet commerical activities, there has been a growing need to move the computer and its associated peripheral devices from the desktop into a central gathering location where family members can share mutually in the Internet experience.

Conventionally however, such computer systems including processors, display monitors, printers, and internet access modems have been to large and bulky to bring into such a central gathering location, such as a family room, for the mutual enjoyment of the family. This problem has been addressed by certain manufacturers who provide integrated audio-visual entertainment centers that include high speed cable programming access as well as high speed internet access. In this regard, the cable box has the built-in capabilities of not only providing television programming displayed on a "cinema size" projection screen but also Internet accesses through a built-in Internet access module and remote keyboard. The size of the typical cable box has been configured to fit within the family entertainment center and thus such an integrated solution has been somewhat successful for viewing Internet content but not fulfilling the .com Internet commercial activities.

More specifically, most, if not all stand alone computer peripheral devices, such a printers and scanners, are not designed with any special aesthetic considerations, other than simply being a functional desktop stand alone device. In this regard, most if not all family households would find it highly undesirable to have a conventional computer printer placed along side the typically electronic equipment found in the family entertainment center.

Therefore it would be highly desirable to have a new and improved computer printer that can be easily integrated into a family entertainment center in an aesthetically pleasing manner. Such a new and improved printer should be stackable with the other electronic components found in the entertainment center and should be easy to use including the changing of printhead cartridges, changing media and clearing the printer of any media jams.

SUMMARY OF THE INVENTION

The present invention provides a low profile stackable internet appliance printer having a removable combination input/output tray cassette with a support mounted therein for holding the output tray in substantially horizontal plane when the output tray is extended outwardly from the cassette a sufficient distance to support from below individual sheets of media discharged from the printer.

BRIEF DESCRIPTION OF THE DRAWINGS

The above mentioned features of the preferred embodiment of the present invention and the manner of attaining them will become apparent, and the invention itself will be best understood by reference to the following description of the embodiments of the invention in conjunction with the accompanying drawings, wherein:

FIG. 15 is a greatly enlarged diagrammatic rear perspective view of a removable cassette bezel for the printer of FIG. 1;

FIG. 16 is a greatly enlarged fragmentary exploded diagrammatic front perspective view of the removable cassette bezel, illustrating it mounting relative to the media cassette of FIG. 5;

FIG. 17 is a greatly enlarged cross-sectional view of the removable cassette bezel of FIG. 16, taken along the line 17—17 thereof;

FIG. 18 is a greatly enlarged cross-sectional view of the removable cassette bezel of FIG. 16, taken along the line 18—18 thereof; and FIG. 19 is a greatly enlarged cross-sectional view of the removable cassette bezel of FIG. 16, taken along the line 19—19 thereof.

DESCRIPTION OF THE PREFERRED EMBODIMENT

Reference is made now in detail to a specific embodiment of the present invention, which illustrates a best mode presently contemplated by the inventors for practicing the invention. Alternative embodiments are also briefly described as applicable. Subtitles are provided herein for reference only; no limitation on the scope of the invention is intended nor should be implied therefrom. Paper pick, print engine and feed drive software and firmware algorithms are well known in the art and beyond the scope of the present invention; therefor, knowledge of a person skilled in the art is presumed and no detailed description of such is provided herein nor is such necessary for an understanding of the present invention.

For ease in understanding the preferred embodiment of the present invention the following outline is provided:

A. Stackable Construction

B. Printhead Access Door and Attachment

C. Base Chassis

D. Combination Input/Output Tray Cassette Unit

E. Input Tray Bezel

F. Paper Observation Frame

G. Open Bottom Paper Path Channel

H. Output Width Adjuster and Kick Out Plate Assembly

A. Stackable Construction

Figure 11:
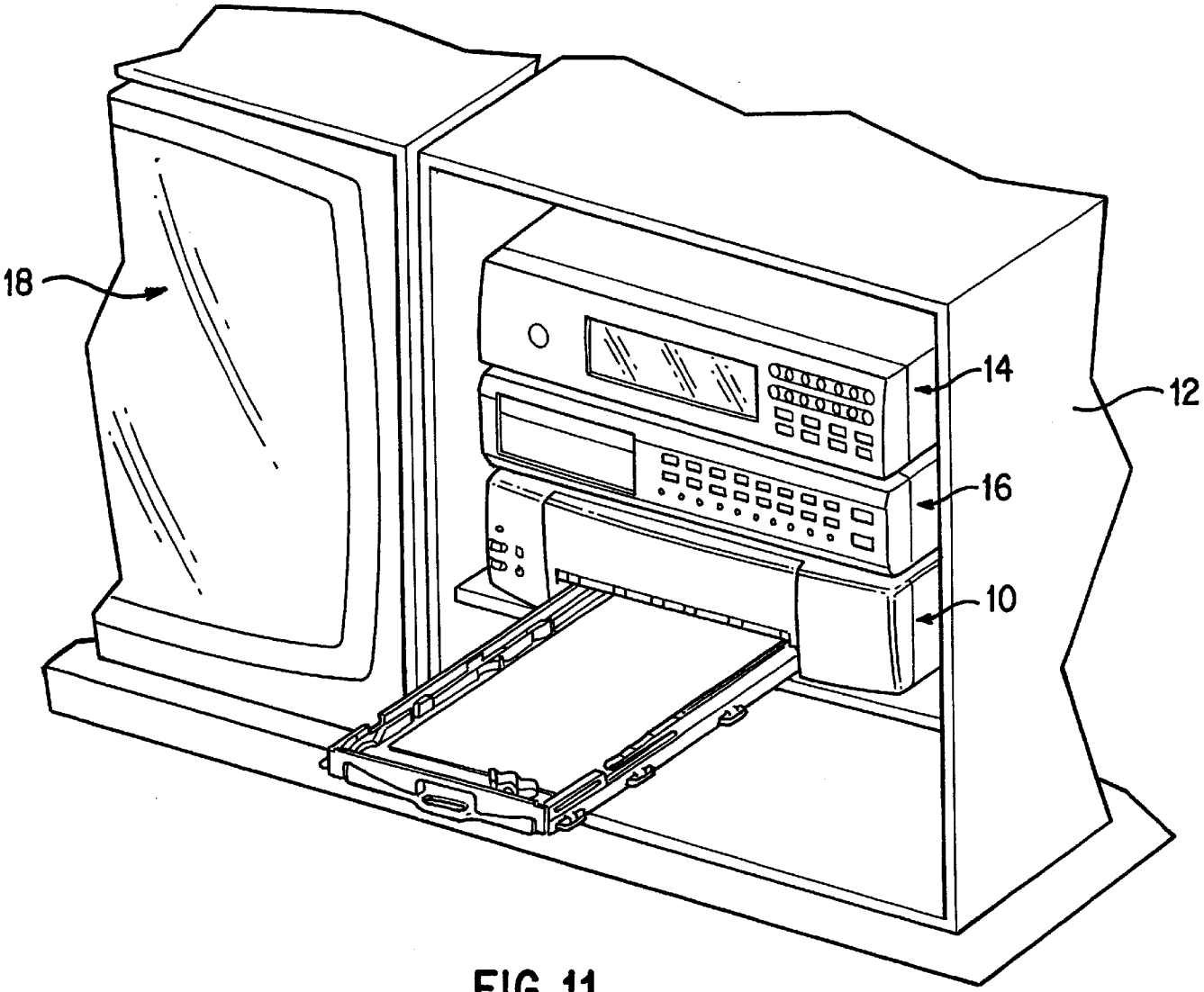
FIG. 11 is a diagrammatic perspective view of the printer of FIG. 1 illustrating the printer stacked within an electronic cabinet with other electronic components.

Referring now to the drawings and more particularly to FIG. 11 thereof, there is shown a low profile internet appliance printer 10 that is constructed in accordance with the preferred embodiment of the present invention. The internet appliance printer 10 is stackable in an electronics cabinet 12 with other electronic components such as a cable box 14 and a digital video device 16. The printer 10 includes internet electronics and a modem (not shown) an thus, is adapted for use with a monitor 18 to enable a user to print desired images and information associated with the information displayed on the monitor 18. For simplicity purposes, the low profile internet appliance printer 10 will be referred to hereinafter as simply "the printer".

Figure 4:
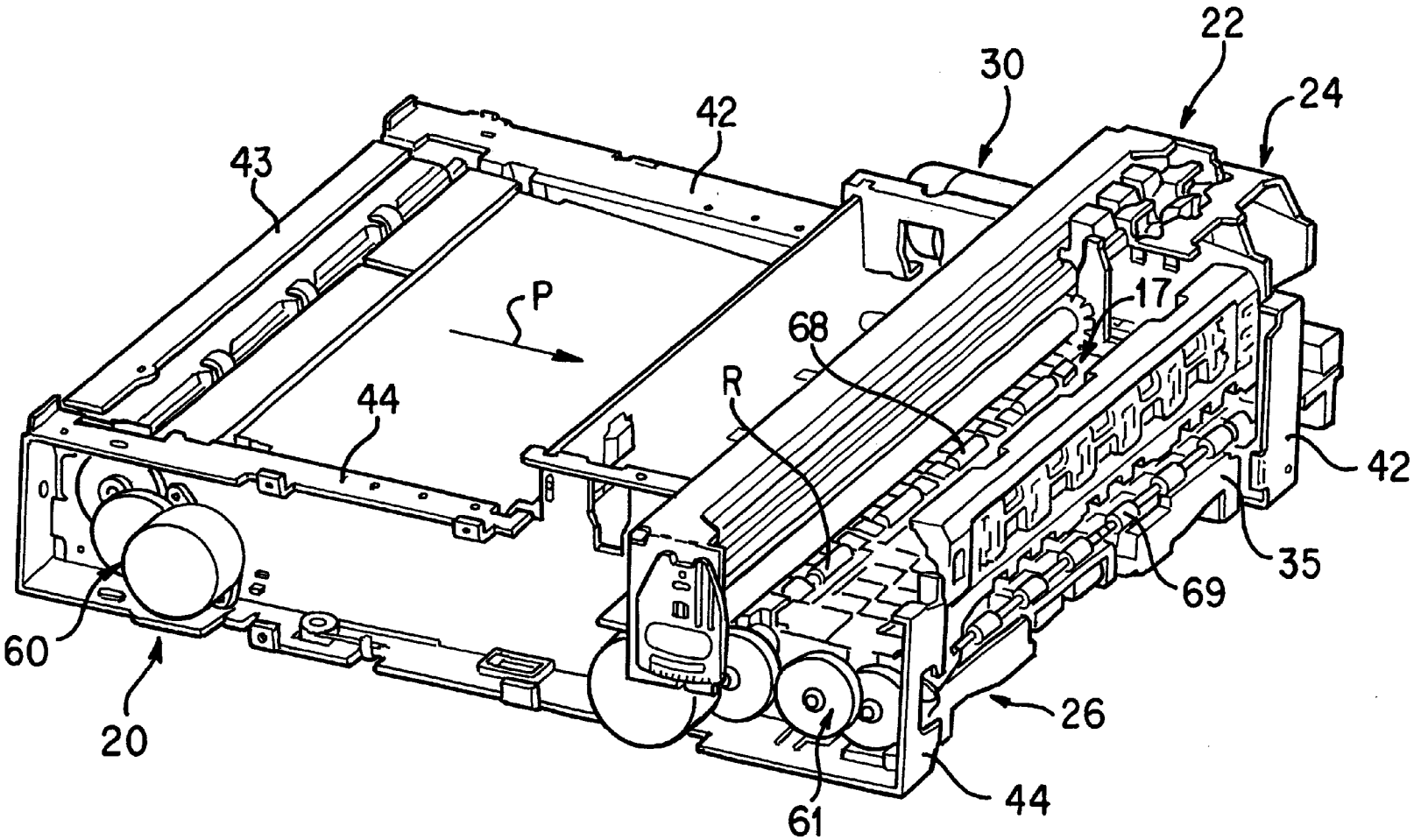
FIG. 4 is an enlarged diagrammatic perspective view of the internet appliance printer of FIG. 1 with its outer skins removed for major component illustration purposes.

The printer 10 is modular in nature and generally comprises a set of assemblies as best seen in FIG. 4 that include a base chassis assembly 20 for supporting from below a low profile print bar assembly 22 and a low profile service station assembly 24. A media cassette assembly 26 is slidably mounted within the base assembly 20 for holding simultaneously a supply of input media and individual sheets of output media until the output media is retrieved by a user (not shown). The base chassis assembly 20 further supports at a rear portion thereof, a motor driven paper pick assembly 60 for facilitating the picking of individual sheets of input media from an input tray 32 forming part of the media cassette assembly 26 and for driving the individual picked sheets along a short paper path P through a print zone 17. A motor driven drive roller assembly 61 mounted at a front portion of the base chassis assembly 20, pulls the individual sheets that have passed through the print zone 17 a further distance along the paper path P so that individual ones of the sheets of media can be ejected into an output tray 34 that also forms part of the media cassette assembly 26. An electronic assembly 30 is also mounted to the base assembly 20 for helping to facilitate the moving of the media along the paper path P and for helping to facilitate the ejecting of ink in a desired pattern onto individual ones of the media sheets as they pass through the print zone 17.

Figure 1:
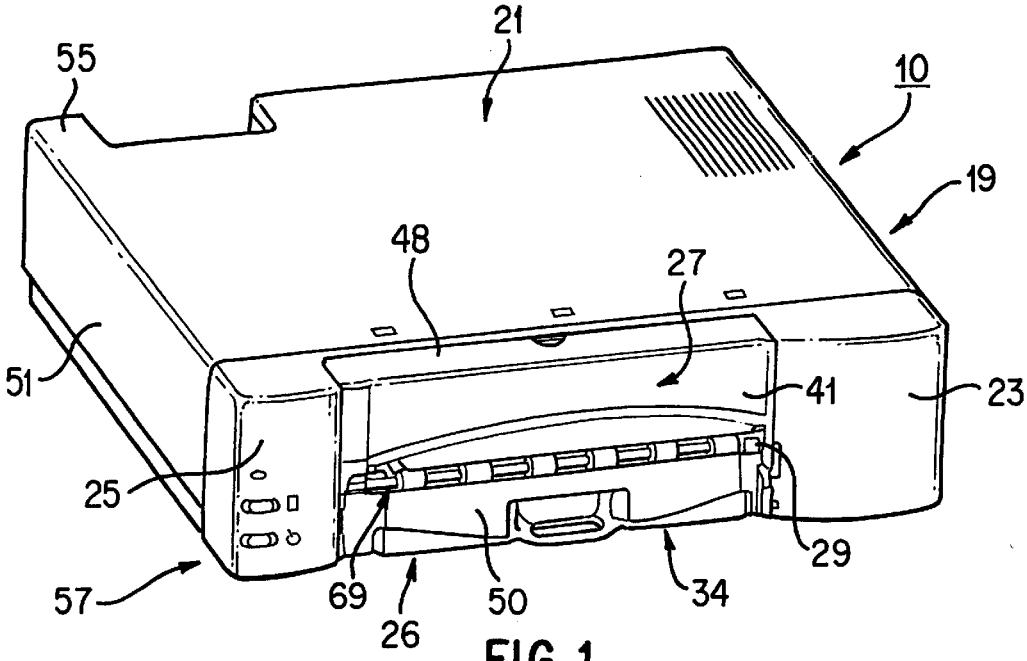
FIG. 1 is a diagrammatic perspective view of a low profile internet appliance printer that is constructed in accordance with the present invention.

A housing 19 covers the assemblies 20, 22, 24, and 30 when they are integrated into a single unit. The housing 19 as best seen in FIG. 1 includes a set of outer skin members: a four-sided main skin member 21, a right front skin member 23, a left front skin member 25 and a bottom plate member 45 (FIG.7) each of which is mounted to the base chassis assembly 20 to provide the printer 10 with an overall box-like configuration. The main skin member 21 has a unitary construction and includes a left side portion 51, a right side portion 52, a rear portion 53 and a top portion 55 each having a generally smooth planar surface to provide the printer 10 with a pleasing aesthetic appearance.

Figure 3:
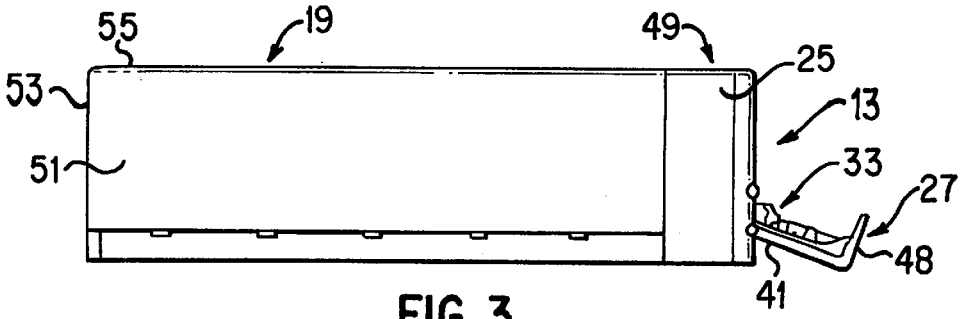
FIG. 3 is a diagrammatic side plan view of the internet appliance printer of FIG. 2 with the front access door illustrated in the open position.
Figure 9:
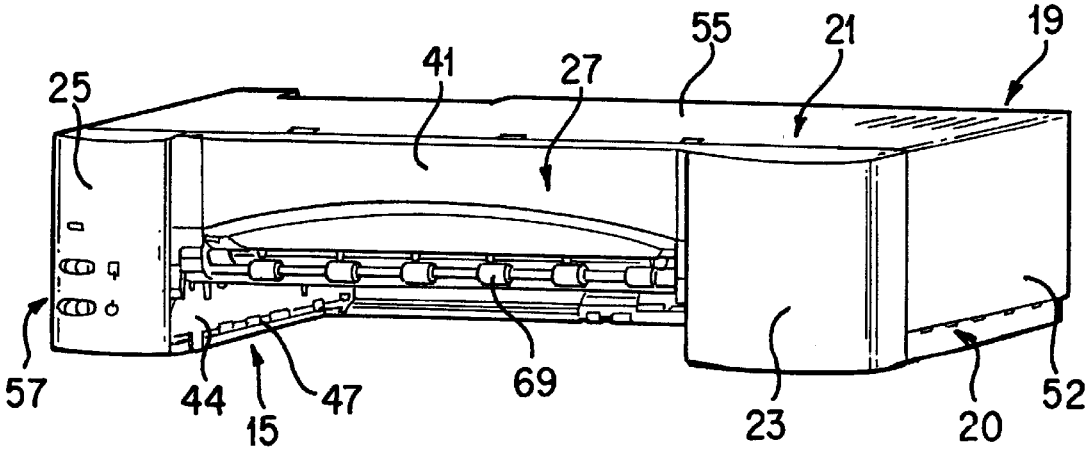
FIG. 9 is an enlarged diagrammatic perspective view of the printer of FIG. 1, illustrating the front of the printer with the media cassette removed therefrom.

As best seen in FIG. 3 and 9, the low profile printer 10 has an upper front passageway indicated generally at 13 and a lower front passageway indicated generally at 15. The upper passageway 13 is covered with an access door 27 having an overall L-shaped configuration. The access door 27 includes a front face member 41 and a top member 48 that are integrally connected at about an angle of ninety degrees as best seen in FIG. 3.

B. Printhead Access Door and Attachment

The access door 27 is pivotally mounted above the lower passageway and extends laterally between the right skin member 23 and the left skin member 25. In this regard, when the access door 27 is positioned in a close position as best seen in FIG. 1, the front face member 41 is disposed flush to the interior side edges of the side skin members 23 and 25 to provide the printer 10 with a pleasing aesthetic appearance. In a similar manner, the top member 48 is disposed in an abutting relationship with a front top edge of the top 55 of the main skin 21 and the top interior side edges of the right skin 23 and the left skin 25 to further provide the printer 10 with a pleasing aesthetic appearance. Moreover, since the top 55 of the main skin 21 abuts the back edges of both the right skin 23 and the left skin 25 an access space indicated generally at 49 is formed when the access door 27 is moved to an open position as illustrated in FIG. 2.

Figure 2:
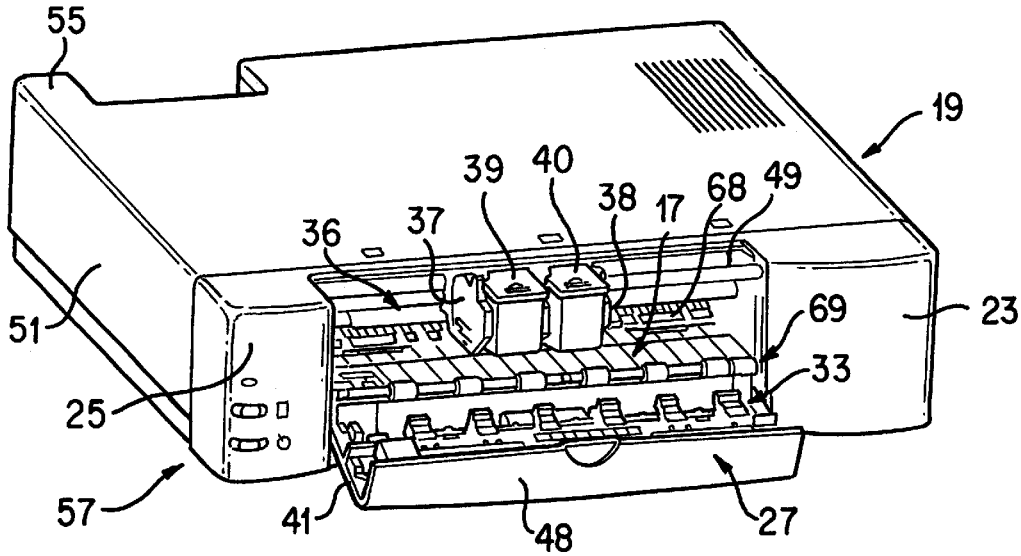
FIG. 2 is a diagrammatic perspective view of the low profile internet appliance printer of FIG. 1, illustrated with a front access door in an open position.

More particularly, when the access door 27 is moved from a close to an open position, as best seen in FIGS. 1 and 2 respectively, access is provided to a low profile carriage assembly 36 that forms part of the low profile printbar assembly 22. The carriage assembly 36 includes a pair of print cartridge stalls 37 and 38 for holding in a secure manner disposable print head cartridges, such as the cartridges 39 and 40. The access space 49 in the top front of the printer 10 permits or allows a user to easily grasp either of the cartridges 39 or 40 for installation or removal purposes from their respective stalls 37 and 38. Such installation or removal of cartridges is made possible even when the printer 10 is stacked beneath other electronic components, such as the electronic components 14 and 16 as illustrated in FIG. 11. In short then, front loading and unloading of print head cartridges 39 and 40 is made possible in the low profile design of the printer 10.

A media output slot indicated generally at 29 (FIG. 12), is disposed adjacent a set 31 of drive rollers to permit media to pass, via the set 31 of drive rollers from the interior print zone 17 through the media output slot 29 into the output tray 34. A set 33 of guides are mounted the interior surface of a front face member 41 of the access door 27 and cooperate with the set 31 of drive rollers to help facilitate the guiding and directing of individual sheets of media toward the output tray 34.

The access door 27 is mounted between a right side chassis member 42 and a left side chassis member 44 that form part of the chassis assembly 20. The right side chassis member 42 supports the service station assembly 24, while the left side chassis, supports a combination user interface and power control module that includes a set 57 of switches, light control diodes, and infrared sensors that extend through the left side skin member 25 so they are visible to a user. The front access door 27 also facilitates the closing of the upper front passageway 13, so that the detectable internal sounds produced by the printer 10 when printing are substantially reduced.

C. Base Chassis

Considering now the base chassis assembly 20 in greater detail with reference to FIGS. 4 and 7–9, the base chassis assembly 20 is box like have a generally rectangular shape and includes a rear chassis assembly 43 that is interconnected between the right side chassis assembly 42 and the left side chassis assembly 44. The bottom or base plate 45 has a unitary construction and is generally U-shaped. The bottom plate 45 is mounted to the bottom of the base chassis assembly 20 so that the underside of the printer 10 is provided with a planar configuration.

A right side slide rail 46 (FIG.8) and a left side slide rail 47 (FIG.7) are formed at the base of the right side chassis 42 and the left side chassis 44 respectively. The rails 46 and 47 are configured to receive and support the cassette 26 when the cassette 26 is slidably mounted thereon.

The lower passageway 15 as seen in a bottom plan view of the printer 10 is U-shaped and is dimensioned for receiving therein the media cassette assembly 26. In a front plan view of the printer 10 the passageway 15 is also U-shape and is disposed in substantial parallel plane alignment with a front face portion 41 of the front door 27. A channel or stop 35 is set back from the entrance to the passageway 15 and is mounted between the right side chassis member 42 and the left side chassis member 44. When the cassette assembly 26 is slidably mounted in the passageway 15, the stop 35 engages a front wall 110 (FIG. 6) of the cassette assembly 26 to limit or stop it from further travel within the passageway 15. As will be explained hereinafter in greater detail, the cassette assembly 26 travels within the passageway 15 riding on the rail members 46 and 47 that form part of the right side chassis member 42 and the left side chassis member 44 respectively.

D. Combination Input/Output Tray Cassette Unit

Figure 5:
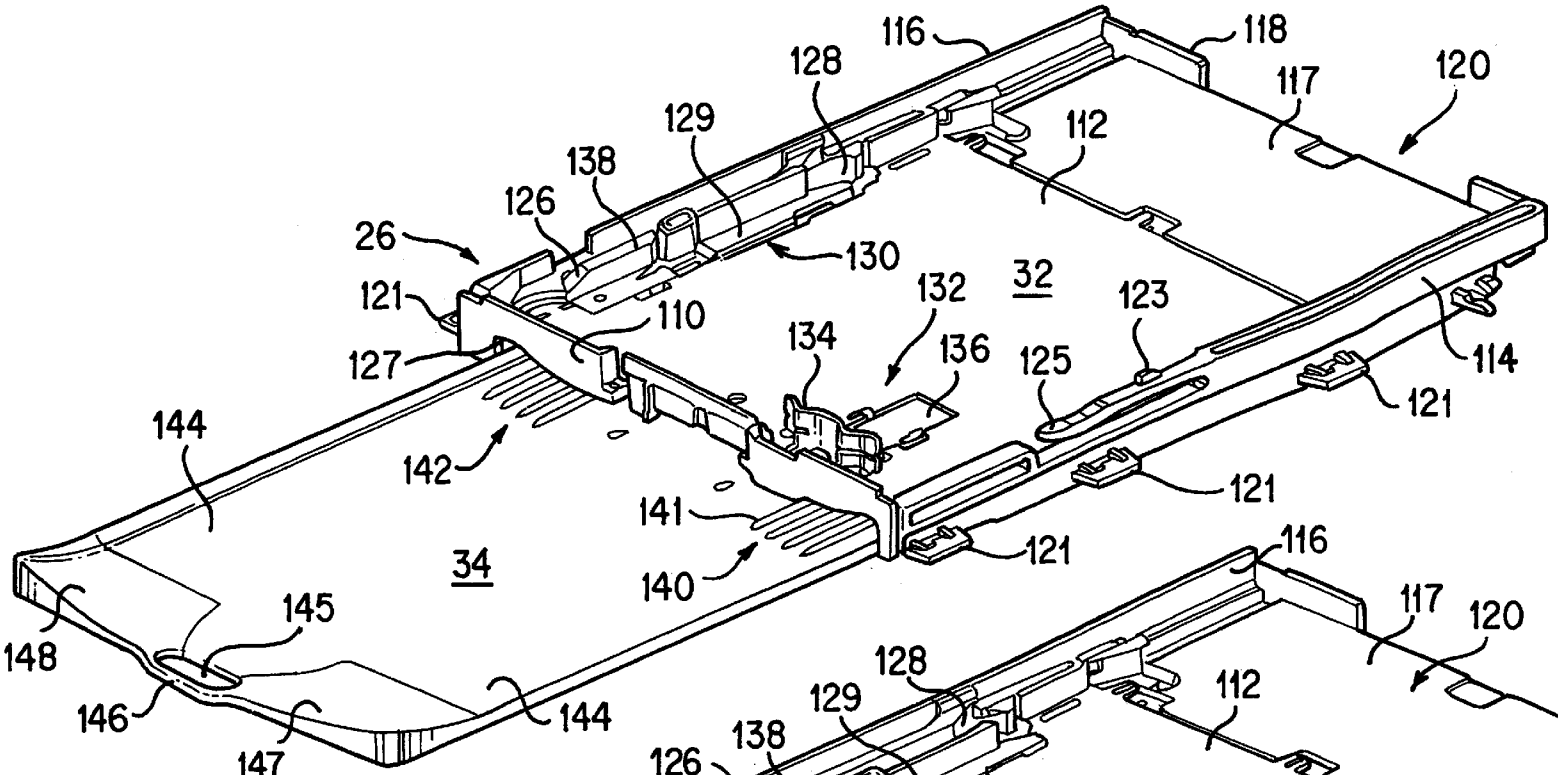
FIG. 5 is an enlarged diagrammatic perspective view of a media cassette of FIG. 1 with bezel removed, illustrating its output tray in a fully extended position.
Figure 6:
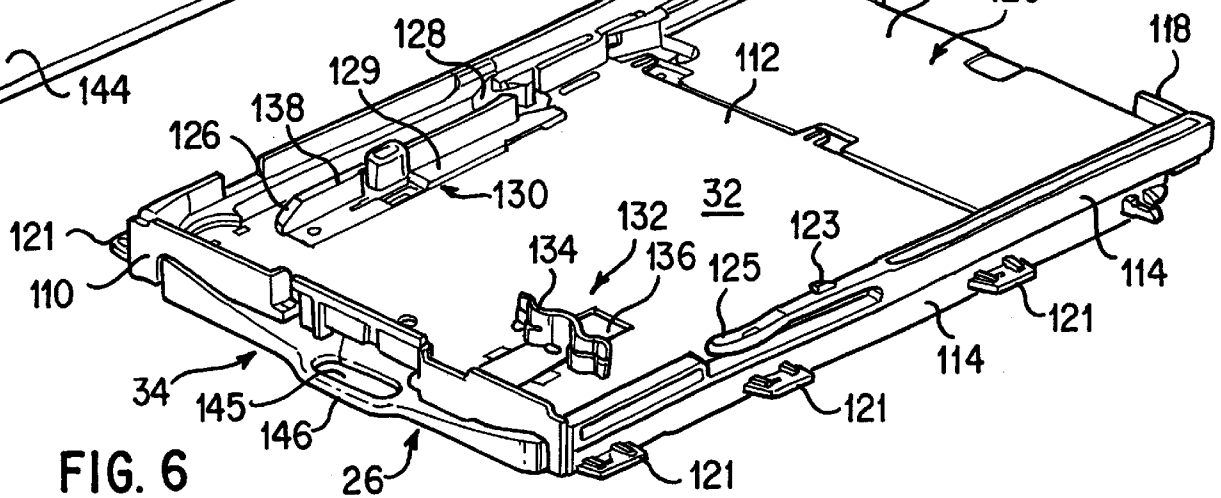
FIG. 6 is an enlarged diagrammatic perspective view of the media cassette of FIG. 1 with bezel removed, illustrating the output tray in a retracted position.

Considering now the media cassette assembly 26 in greater detail with reference to FIGS. 5–6, the media cassette assembly 26 is a combination input/output tray cassette unit that is completely removable from the printer 10. The assembly 26 includes both the input tray 32 for receiving and holding media, such as paper, for printing thereon, and the output tray 34 for receiving and holding media after it has been printed thereon. In short then, the single cassette 26 holds both the media for printing on and the media printed on after passing through the printer 10.

Figure 7:
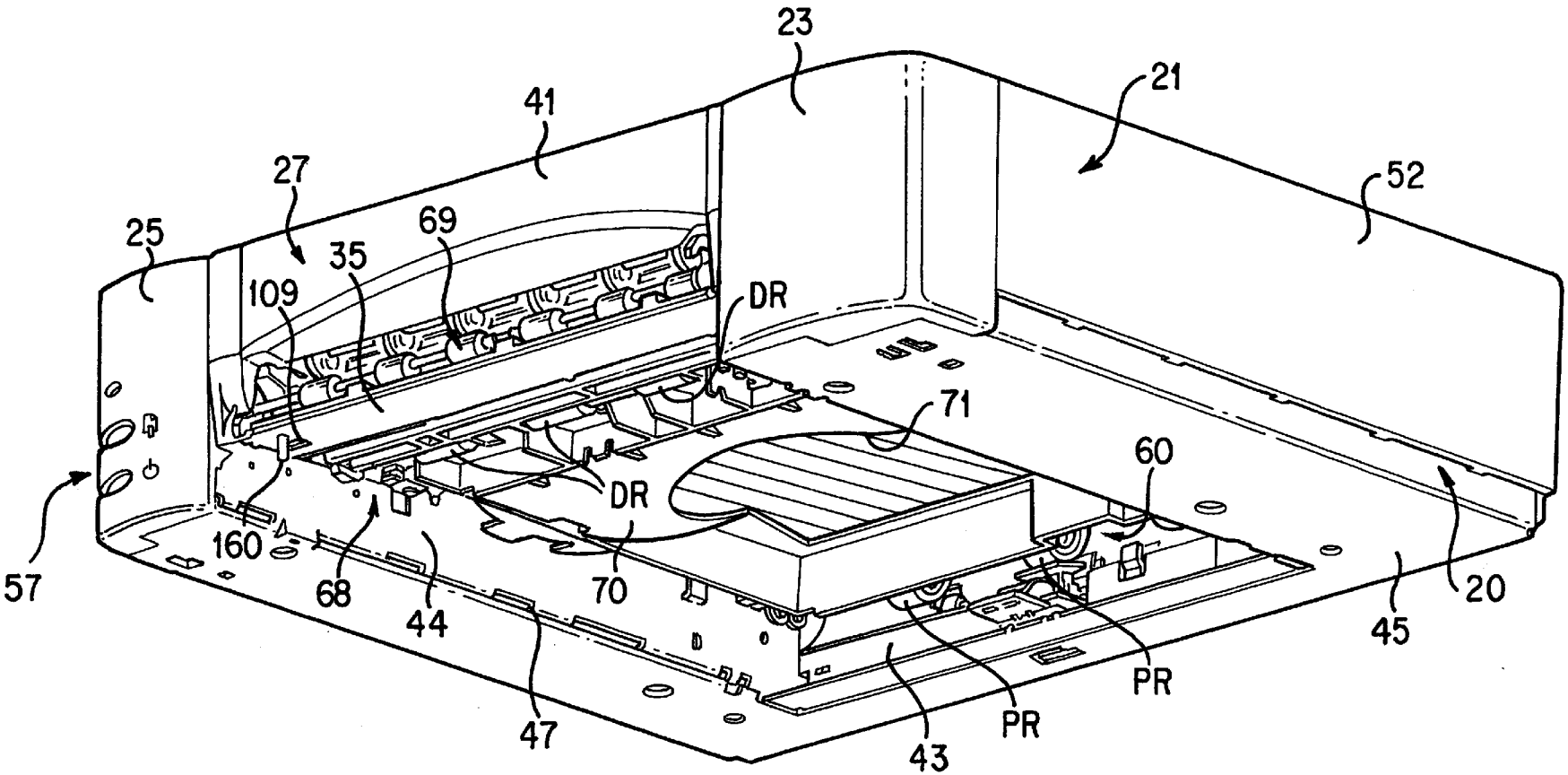
FIG. 7 is an enlarged diagrammatic perspective view of the printer illustrated in FIG. 1, showing the underside of the printer with the media cassette removed therefrom.
Figure 8:
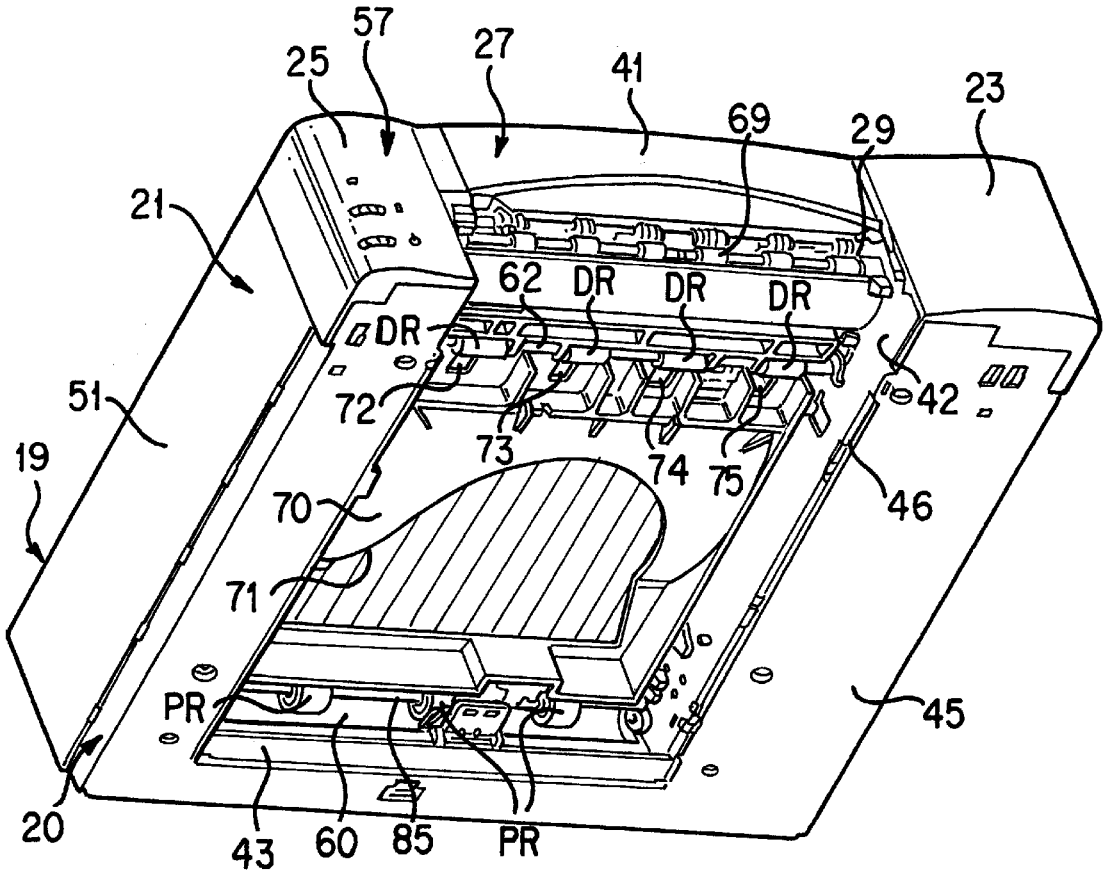
FIG. 8 is an enlarged diagrammatic perspective view of the printer of FIG. 1 with its front in a raised positioned with a media cassette removed therefrom.
Figure 12:
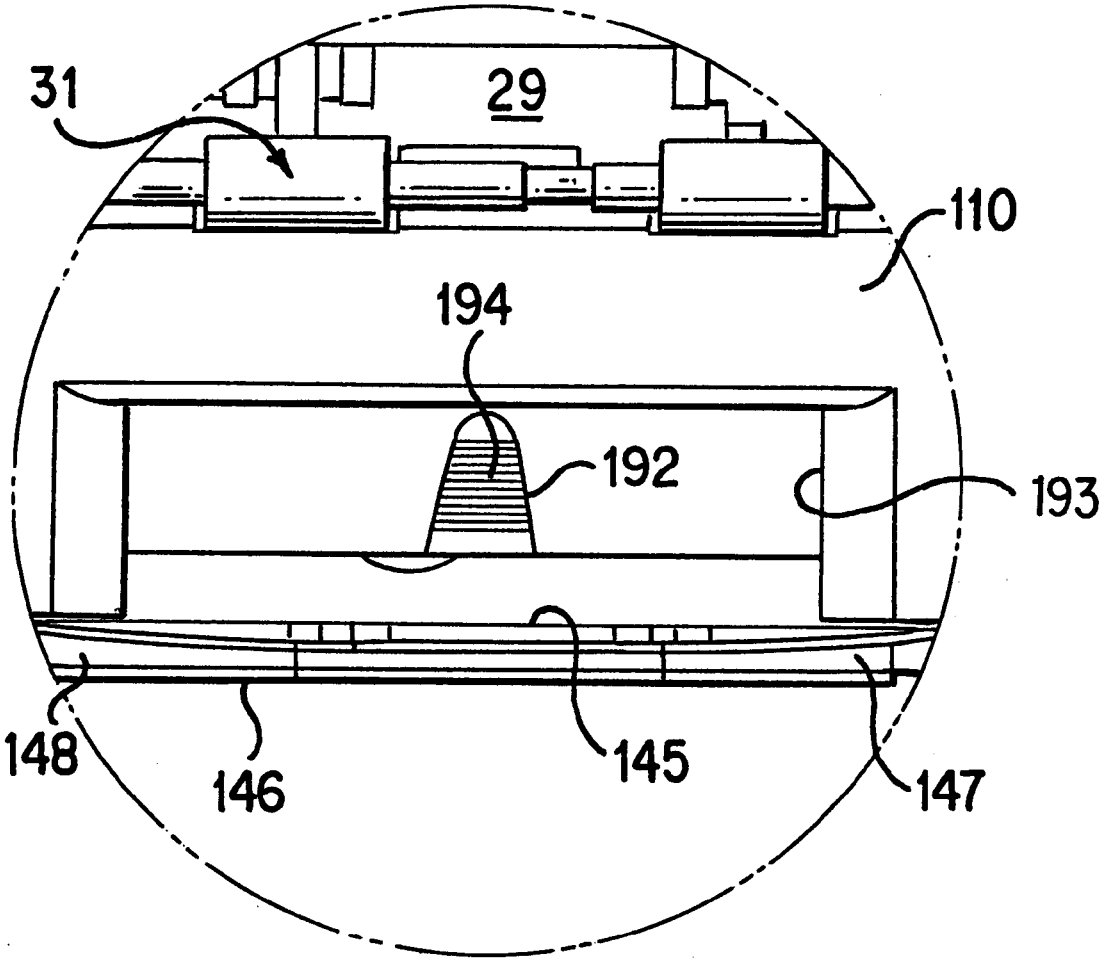
FIG. 12 is a greatly enlarged fragmentary diagrammatic front plan view of a front portion of the media cassette FIG. 5 illustrating a front window thereof.

As best seen in FIGS. 7–9, when the cassette assembly 26 is removed from the passageway 15, a large open access space results which makes available to a user access to most if not all of the internal paper path that media follows during the printing process. A large rectangular shaped channel member 70 (FIG. 10) is disposed within this space mounted between the right side chassis 42 and the left side chassis 44 and extends between the rear pick roller assembly 60 and a set 68 of drive rollers (DR) forming part of the front drive roller assembly 61. In this regard, as media is picked from the input tray 32 it travels along the media path P and is supported from below by the upper surface of the channel member 70. The channel member 70 will be described hereinafter in greater detail. It should suffice to indicate at this point that a large cutout 71 provided in the channel manner 70 coupled with the large space that results in the underside of the printer 10 when the cassette assembly 26 is removed therefrom, provides a means for a user to clear and remove any media that might accidentally become jammed within the interior media path P of the printer 10. In this regard, the access to the interior of the printer 10 from the passageway 15 via the cutout 71 permits the printer 10 to be stacked with other electronic components as best seen in FIG. 12.

Considering now the cassette assembly 26 in greater detail with reference to FIGS, 5 and 6, the cassette assembly 26 is of a generally rectangular shape having the front wall 110, a bottom wall or floor 112, a pair of side walls 114 and 116 respectively, and a back or end wall 118. The front, rear and side walls of the cassette 26 are generally of the same height and form a large space indicated generally at 120. The space 120 is sufficiently large for receiving both standard A size media (8 ½-inch by 11-inch paper) as well as the narrow and longer A4 paper. A moveable pressure plate 117 is disposed at a rear portion of the cassette 26 for helping to facilitate the picking of media from the input tray.

As best seen in FIGS. 5 and 6, the side walls 114 and 116 provide a stair step shape configuration with the bottom portion of the walls being recessed inwardly from the top portion of the walls 114 and 116. A set of guides, such as a guide 121, projects outwardly from the bottom portion of each side wall 114, 116 and is spaced apart from one another. The guides 121 cooperate with the top portions of the side walls 114 and 116 to form rail-receiving channels there between to receive the rails 46 and 47 respectively.

An output tray receiving slot or opening indicated generally at 127 (FIG.5) is formed in the front wall 110. The slot 127 is dimensioned for receiving therein the output tray 34. In this regard, the slot 127 extends beneath the floor 112. The output tray 34 is supported within the slot 127 by a set of spaced apart rails (not shown) that are disposed on the interior surfaces of the bottom portions of the side walls 114 and 116 respectively. In short then, the top surface area of the bottom floor 112 is about equal to the surface area of the top surface of the output tray 34. The area of the space 120 and that portion of the space 120 that is utilized for accommodating the different sizes of media is larger in overall area than the output tray 34. In this regard, the output tray 34 has an area size that is between about two-thirds to three-fourth the overall area size of the space 120.

Considering now the input tray 32 in greater detail with reference to FIGS. 5–7 and 13, the input tray 32 includes an output width adjuster slide assembly 130 and a paper length adjuster or slide 132 that help facilitate the loading and discharge of different sized media from the printer 10. As will be explained hereinafter in greater detail, the assembly 130 engages a kick out plate adjuster pin 160 (FIG.7) to facilitate the proper discharge of media into the output tray 34.

The paper length adjuster slide 132 includes a media engaging tab 134 that travels in an opening 136 disposed in the floor 112. The tab 134 is movable between two different size setting: an A-4 media size setting position as best seen in FIG. 6 and an A-1 media size setting as best seen in FIG. 5. In the first setting size, as best seen in FIG. 5, the side edges of the media are engaged between the interior of the side wall 114 and an interior wall portion of a slide member 138 that forms part of the output width adjuster 130. The top edge of the media engages the face of the slide member 138 while the bottom edge engages the back wall 118.

In the second setting size, as best seen in FIG. 6, the side edges of the media are engaged between the interior of the side wall 114 and the interior wall of the slide member 138. The top edge of the media engages the face of the slide member 134 (which has now been positioned to the second size position) while the bottom edge of the media engages the back wall 118.

In a similar manner, the output width adjuster slide assembly 130 is moveable between two different size settings in a similar manner as the paper length adjuster slide 132. The operation of the output width adjuster slide assembly 130 will be describe hereinafter in greater detail. From the foregoing it should be understood by those skilled in the art, that different sizes of media are accommodated within the space 120 by the adjustment of the slides 130 and 132, and that the slides 130 and 132 cooperate with the side wall 114 and the back wall 118 to form a proper size input tray cassette having a general rectangular shape.

Considering now the output tray 34 in greater detail with reference to FIGS. 5 and 6, the output tray 34 is slidably mounted within the cassette 26 so that it can be telescopically extended and retracted. When extended, the output tray 34 has a sufficient dimension to support either a standard A-1, 8 ½ by 11-inch media sheet or an A4 media sheet, which sizes are the same as can be held within the input tray 32.

As best seen in FIG. 5, the output tray 34 has a unitary construction and includes a base member 144 having a set of spaced apart rib or riser members indicated generally at 140 and 142 respectively which are integrally attached to a top surface thereof. As will be explained hereinafter in greater detail, the rib members 140 and 142 are constructed to simultaneously engage the front wall 110 of the cassette 26 when the output tray 34 is pull telescopically outward from the cassette 26. In this manner, the risers 140 and 142 stop the outward travel of the output tray 34 positioning the output tray 34 in a proper position for supporting from below sheets of media as they are driven out of the printer 10 by the set 31 of drive rollers. As the riser members 140 and 142 are substantially identical in construction, only the riser members 140 will be described in greater detail.

The riser members 140 include four spaced apart risers, such as a riser 141. The riser 141 has a narrow elongated construction that extends upwardly a sufficient distance from a front or proximate end thereof toward a rear or distal end to engage the underside of the front wall 110 of the cassette 26. In this manner when the riser 141 engages the underside of the front wall 110 the forward travel of the output tray extending outwardly from the cassette 26 is inhibited.

From the foregoing, it should be understood by those skilled in the art that the riser member 140 and 142 because of their orientation on opposite sides of the output tray 34 interlock the underside of the front wall 110 at about the end of the path of travel followed by the output tray 34 allowing the output tray to easily slide through most of its motion and yet tilt at about a zero degree to about a two degree angle at the end of its travel motion to facilitate the capture and holding of output media discharged from the printer 10.

In order to help facilitate the extending of the output tray 34 from the cassette 26, the output tray 34 further includes an opening 145 that is disposed adjacent to a front edge 146 of the output tray and between a pair of wedge members 147 and 148 respectively. The opening 145 functions as a griping handle that can be grasp by a user to pull the output tray 34 outwardly from the cassette 26. The wedge members 147 and 148 slope upwardly from the upper surface of the base 144 reaching their maximum height at the respective front corners of the output tray. In this manner the wedge members 147 and 148 function as stops to limit the forward travel of the media sheets as they are driven in seriatim from the printer 10 so that the media sheets are stacked on the upper surface of the base 144.

In use, when the cassette 26 is inserted into the passageway 15, the cassette 26 is fully received within the printer 10 without the output tray 34 extending beyond the front face of the printer 10. The cassette 26 slides along the rails 46 and 47 until a front wall member 110 thereof engages the channel stop 35. When the cassette 26 is pulled out from the passageway 15, the cassette 26 travels in a reverse direction along the rails 46, 47 until a stop member 123 of a right side wall 114 of the cassette engages a backside of the channel stop 35. As will be explained hereinafter in greater detail, the right side wall 114 includes an elongated flexible extension 125 that can be depressed by the user to release the stop 123 from engagement with the channel stop 35. The extension 125 is integrally attached at its proximate end to the main body portion of the side wall 114 and has a narrow concave configuration at its distal end to help a user locate that portion of the extension that needs to be pressed to release the cassette 26 from the lower passageway 15.

More particularly, when the extension 125 is depressed in a down direction, the cassette 26 can continue its reverse path of travel under the force of the user allowing the cassette 26 to be completely removed from the printer 10. From the foregoing, it should be understood by those skilled in the art, that the cassette 26 can be moved a sufficient distance out from the interior of the printer 10 to allow the cassette 26 to be filled or refilled with a desired type of media. Furthermore, the cassette 26 can be completely removed from the printer to give the user access to the interior of the printer 10 via the access passageway 15 and the cutout 71. In this manner, the clearing of paper jams is facilitated while the printer 10 remains in a stacked orientation with other electronic components as best seen in FIG. 7.

E. Input Tray Bezel

Considering now the cassette assembly 26 in greater detail with reference to FIGS. 1 and 15–19, the bezel 50 has a unitary construction that generally includes a left side wall member 199, a right side wall member 198 and a central wall member 200. The respective ones of the side wall members 198 and 199 have cutouts that are sufficient large to permit the output tray 34 to pass therethrough. Integrally connected and extending perpendicular to the side walls 198 and 199 are a pair of wing members 190 and 191.

As best seen in FIG. 16, the bezel 50 is mounted removably to the front wall 110 and the side walls 114 and 116 for providing the cassette 26 with a pleasing aesthetic appearance. In order to help secure the bezel 50 to the cassette 26, a right side snap or projection 180 and a left side snap 181 extend outwardly from the lower portions of the side walls 114 and 116 respectively at their lower distal ends adjacent to the front wall. A pair of snap engaging opening 182 and 183 for engaging the side wall snaps 180 and 181 .The opening 182 and 183 are disposed in the lower portions of the wing members 190 and 191 respectively.

To further help secure the bezel 50 to the cassette 26, the bezel 50 also includes a pair of spaced apart fixing pins 184 and 185 that are dimensioned for sliding engagement with a corresponding pair of centrally disposed pin holes 186 and 187 (FIG.16) disposed in the cassette 26 at the front wall 110 thereof. The pins 184 and 185 form part of a boss 197 that projects outwardly from the central wall 200. An opening is formed in the boss 197 and is defined by two interior walls 195 and 196.

A pair of spaced apart overhangs 188 and 189 is disposed on the rear face of the bezel 50. The top edge portion of the front wall 110 supports from below the overhangs 188 and 189. In summary then, when the bezel 50 is attached to the cassette 26, the bezel 50 is mounted to the front wall 110 between the two side walls 114 and 116 respectively.

F. Paper Observation Frame

As best seen in FIG. 12, the front wall 110 of the cassette assembly 26 includes a centrally disposed rectangular shaped recess 193. The recess 193 is disposed opposite the opening 145 to help prevent the fingers of the user from engaging the front wall when the user pulls the output tray 34 outwardly. A semi-elliptical cutout 192 is disposed in the center of the recess 193 to provide an observation window or frame to the interior of the input tray 32. Thus, as best seen in FIG. 12 when the input tray 32 is loaded with a stack of input media 194, the user is able to determine the amount of input media that remains in the input tray 32 by simple observation. The semi-elliptical cutout 192 is wider at its base adjacent the output tray than at its top adjacent the top of the recess 193. In this manner, the user is able to have a greater view of a low supply of media than a full supply of media.

G. Open Bottom Paper Path

Figure 10:
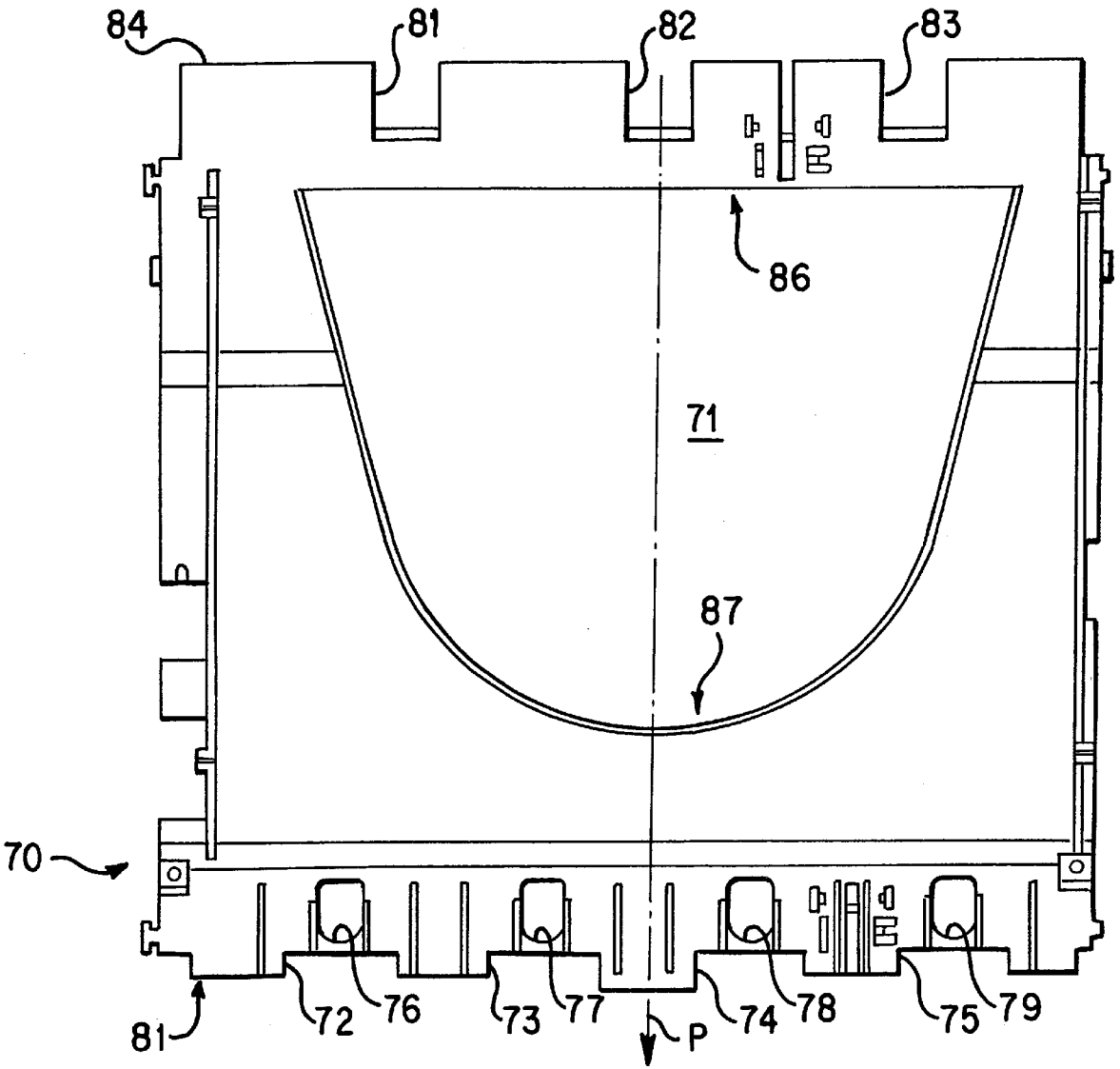
FIG. 10 is an enlarged diagrammatic top plan view of a media channel member of the internet appliance printer illustrated in FIG. 8.

Considering now the channel member 70 in greater detail with reference to FIGS. 7–8 and 10, the channel member 70 is mounted between the rear pick roller assembly 60 and the rear set 68 of drive rollers (DR) forming part of the front drive roller assembly 61. The channel member 70 is disposed within the passageway 15 such that the upper surface of the channel member is in a parallel plane with the nips of the set 68 of the set 68 of the rear drive rollers (DR) so that media passing along the top surface of the channel member 70 is directed into the nips of the drive rollers.

The front of the channel member 70 includes a plurality of notched cutouts 72–75 that are dimensioned to be slightly larger in width than individual ones of the drive rollers DR of the drive roller assembly 61. In this regard, a front edge portion 81 of the channel member 70 is mounted in adjacent abutment to the rollers DR without making direct contact with the rollers or the drive shaft 62 of the drive roller assembly 61. Centrally disposed openings, such as the openings 76–79 are disposed opposite each one of the notched cutouts 72–75 and spaced from the central cutout 71. The opening 76–79 provides further access to the paper path P.

Another set of notched cutouts 81-83 are disposed at the rear portion of the channel member 70. The notched cutouts 81–83 are dimensioned to be slightly larger in width than individual ones of the pick rollers PR of the pick roller assembly 60. In this regard, a rear edge portion 84 of the channel member 70 is mounted in adjacent abutment to the pick rollers PR without making contact the pick rollers PR of their associated drive shaft 85.

As best seen in FIG. 10, the cutout 71 has a generally elliptical shape with a wide base indicated generally at 86 and a narrow top indicated generally at 87. The cutout 71 is centrally disposed within the channel member 70 and space from the front notched cutouts 72–75 and the rear notched cutouts 81–83. In this manner, the cutouts 71, and 72–75, and 81–83 in combination provide a substantially open paper path that facilitates the easy removal of substantially any paper jam without the need of the user lifting the printer 10 from its supporting surface.

H. Output Width Adjuster and Kick Out Plate Assembly

Figure 14:
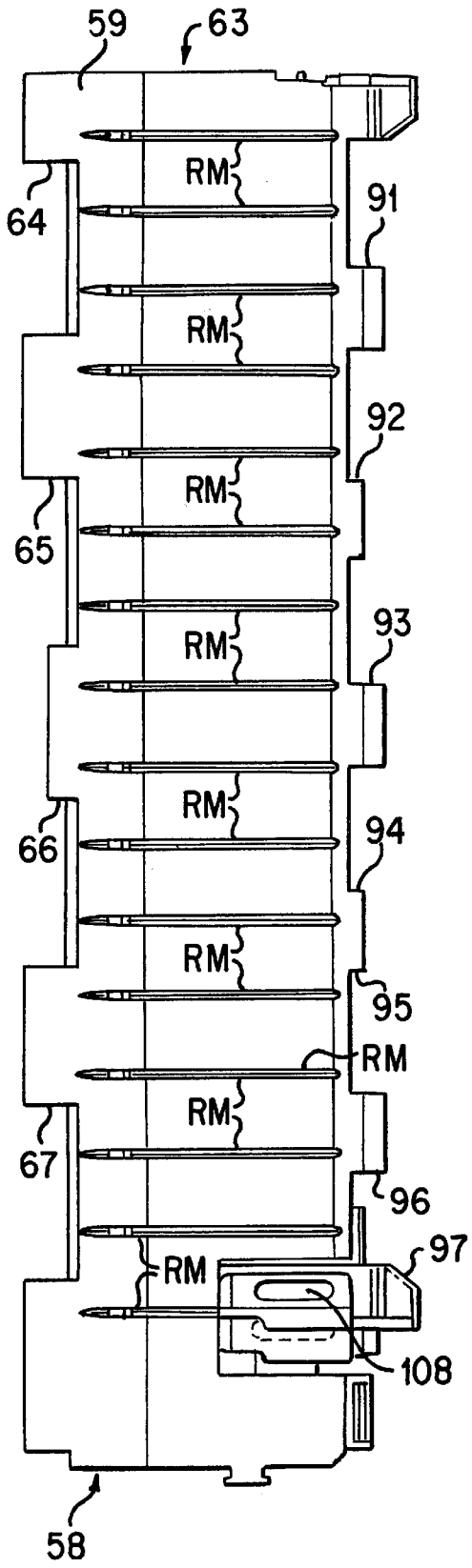
FIG. 14 is a greatly enlarged diagrammatic top plan view of a kick out plate of the printer of FIG. 1, illustrating two kick out positions.
Figure 13:
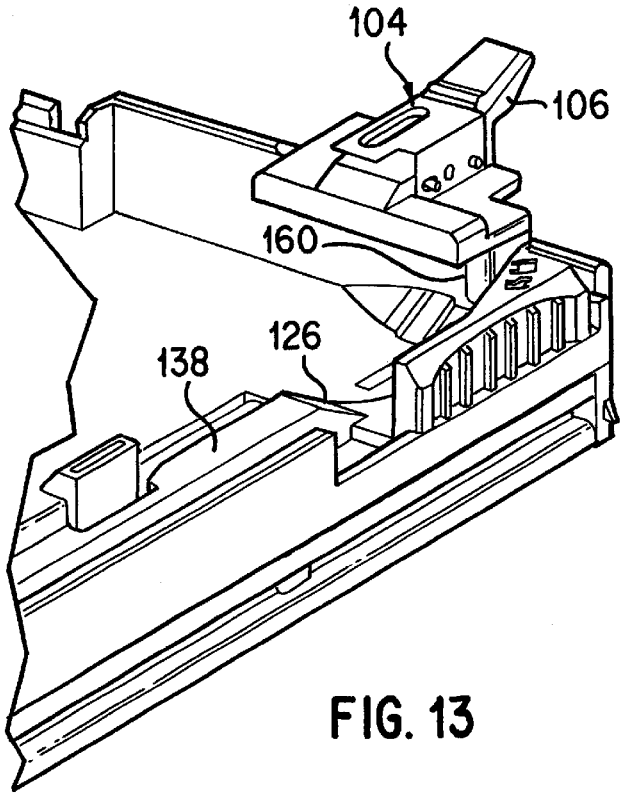
FIG. 13 is a greatly enlarged fragmentary diagrammatic perspective view of the output width adjuster assembly of FIG. 7, illustrating a cam action engagement for kick plate adjustment.

In order to align the output media properly as it passes from the media output slot 29 to the output tray 34, the printer 10 includes a kick out plate assembly 58 (FIG. 14). The kick out plate assembly 58 generally comprises a platen or ribbed kicked out plate 59 that is mounted between the rear set 68 and the front set 69 of drive rollers and extends between the right side chassis 42 and the left side chassis 44. The kick out plate 59 has a set 63 of upstanding rib members (RM) that help guide the output media through the media output slot 29 toward the output tray 34. The kick out plate 59 includes at its back edge a series of spaced apart cutouts 64–67 that are dimensioned to allow the kick out plate 59 to be mounted adjacent the set 68 of the drive rollers forming part of the drive roller assembly. The kick out plate 59 also includes at its front edge a series of spaced apart cutouts 91–95 that are dimensioned to allow the kick out plate 59 to be mounted adjacent the front set 69 of the drive rollers forming part of the drive roller assembly.

A large cutout 96 is disposed next to cutout 95 and is dimensioned for receiving therein an output edge slide 97 that forms part of the output width adjuster slide assembly 130.

Considering now the output width adjuster slide assembly 130 in greater detail with reference to FIGS. 5–7 and 14, the assembly 130 generally includes the input tray slide member 138 that is disposed in the input tray 32, a pin assembly 104 that is mounted at a distal end of the media output slot 29 above the kick out plate 59 and the output edge slide 97. The pin assembly 104 includes a finger-engaging unit 106 that supports from above the kick out plate adjuster pin 160. In this regard, the pin 160 extends perpendicularly down from the finger engaging unit 106 passing through an adjustment hole 108 disposed in the kick out plate 58 and a corresponding hole 109 disposed in the channel member 35. The pin 160 has a sufficient length so that its distal free end is disposed within the interior of input tray 32 when the cassette 26 is mounted in the printer 10.

Considering now the operation of the output width adjuster slide assembly 130 in greater detail, when the user adjusts the paper length adjuster 132 for A4 size media, the user also adjusts the finger engaging unit 104 for A4 media by sliding the unit 104 into a proper A4 position. The stack 194 of A4 size media is then placed in the input tray 32.

The user next inserts the cassette 26 into the printer 10 sliding the cassette 26 into the printer 10 until it is fully inserted. As the cassette 26 is being positioned in the printer 10, the pin 160 engages a cam surface 126 that causes the slide 138 to be pushed rearwardly along its first path of travel. As the slide 138 is pushed rearwardly, it distal end furthest from the pin 160 engages another cam surface 128 causing the slide to move in a horizontal direction. A slide plate 129 integrally attached to the slide 102 moves into engagement with the floor 112 narrowing the width distance between the slide 138 and the side wall 114. The narrow width is sufficient for A4 size media.

When the slide unit 138 is positioned for A size paper, the pin 160 is unable to engage the cam surface 126. It should be noted that since the pin passes through the hole 108 in slide 97, the slide 97 is automatically positioned providing the proper kick out for media passing through the media output slot 29. In short then, the output edge slide 97 is moveable between two position within the cutout 96: an A4 size position as seen in solid line in FIG. 14 and in an A size position as seen in dash line in FIG. 14.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

We claim:

1. A media cassette, comprising:

an input tray for holding a supply of input media;

an output tray for holding output media discharged from a printer; and a support integrally mounted to a top surface of said output tray, said support including at least one set of spaced apart wedges disposed at a rear portion of the top service for helping to facilitate the holding said output tray in a substantially horizontal plane when said output tray is extended outwardly from the cassette a sufficient distance to support from below individual sheets of media discharged from the printer.

2. A media cassette according to claim 1, wherein said support holds said output tray at an angle to the horizontal of about zero degrees to about two degrees.

3. A media cassette according to claim 2, wherein a more preferred angle to the horizontal is about one degree to about two degrees.

4. A media cassette according to claim 3, wherein a most preferred angel to the horizontal is about two degrees.

5. A media cassette according to claim 1, wherein said output tray is sufficiently large to hold A size and A4 size media.

6. A media cassette according to claim 1, wherein said output tray can be telescopically extended and retracted from the interior of the cassette.

7. A media cassette according to claim 1, wherein said media cassette is dimensioned to be slidably installed and removed from a low profile printer having height, width and depth dimensions substantially corresponding to a stackable home entertainment center electronic device.

8. A media cassette, comprising:

an input tray for holding a supply of input media;

an output tray for holding output media discharged from a printer;

a support integrally mounted to a top surface of said output tray for holding said output tray in a substantially horizontal plane when said output tray is extended outwardly from the cassette a sufficient distance to support from below individual sheets of media discharged from the printer;

wherein said output tray has a unitary construction; and wherein said support includes at least one set of spaced apart wedges disposed at a rear portion of said top surfaces, wherein individual ones of said wedges interlock with a part of the cassette at about the end of the path of travel followed by the output tray allowing the output tray to freely travel through most of its motion and yet tilt at an angle to the horizontal of between about zero degrees and about two degrees at the end of its travel motion to facilitate the capture and holding of the individual sheets of output media.

* * * * *